United States Patent [19]

Heidemann et al.

[11] Patent Number: 4,694,917

[45] Date of Patent: Sep. 22, 1987

[54] MECHANICAL JARRING DEVICES FOR USE IN DRILLING

[75] Inventors: Gerhard Heidemann, Witten-Stockum; Johannes Witte, Brunswick, both of Fed. Rep. of Germany

[73] Assignee: Eastman Christensen Co., Salt Lake City, Utah

[21] Appl. No.: 846,585

[22] Filed: Mar. 31, 1986

[30] Foreign Application Priority Data

Apr. 12, 1985 [DE] Fed. Rep. of Germany ..... 3513123

[51] Int. Cl.[4] ..... E21B 4/06; E21B 31/107

[52] U.S. Cl. ..... 175/299; 175/300; 175/304

[58] Field of Search ..... 175/304, 300, 299, 293; 166/178

[56] References Cited

U.S. PATENT DOCUMENTS

| | | | |
|---|---|---|---|
| 2,144,869 | 1/1939 | Boulter | 175/300 |
| 2,199,969 | 5/1940 | Hamm | 175/304 |
| 2,309,872 | 2/1943 | Shaffer et al. | 175/304 |
| 2,336,564 | 12/1943 | Osmun | 175/304 |
| 3,658,140 | 4/1972 | Berryman | 175/304 |

*Primary Examiner*—Stephen J. Novosad
*Assistant Examiner*—Bruce M. Kisliuk
*Attorney, Agent, or Firm*—Beehler, Pavitt, Siegemund, Jagger, Martella & Dawes

[57] ABSTRACT

A jarring device for use in drilling comprises first and second members longitudinally relatively movable between a locked position and a released position said device comprising control means including a pair of locking devices each arranged to prevent relative movement between said members until a predetermined force is applied to one of said movable members in either of two longitudinal directions. The control means includes two locking devices each of which locks in one of the two directions.

The locking devices may comprise pivotable bolts pivoted on a sliding member so that the free ends of the bolts contact an abutment on one of the movable members to effect locking, the bolts being retracted from engagement with the abutment by movement of the sliding member.

11 Claims, 3 Drawing Figures

MECHANICAL JARRING DEVICES FOR USE IN DRILLING

BACKGROUND OF THE INVENTION

1. Technical Field

The invention relates to mechanical jarring devices for use in drilling. Jarring devices are employed, for example, to loosen or release objects or obstructions in a bore-hole, such as a drill bit which has become jammed.

2. Description of Prior Art

U.S. Pat. specification No. 1,798,480 describes jarring devices of this type. Such devices include members which are connected together for limited relative longitudinal movement. The members are held together by means which provide for a sudden release of the members for longitudinal movement causing a jarring or hammering action.

The prior specification referred to describes a jarring device in which the two members are held in a retracted position by latch means which can be released by simple reciprocation of one of the members. This avoids relatively complex arrangements hitherto employed such as the use of pressurised fluids or rotation of the drill string to which the jarring device is attached.

This simple method of operation is achieved by the provision of a latching device comprising a sliding sleeve which can slide relative to one of the members and which is connected to the member by axial tension springs. The sliding sleeve carries a plurality of pivoted latching elements which can engage with a cooperating abutment on the other of the members to prevent relative movement between the members. The latching elements are held in position by a locking collar associated with said one of the members.

The latching means is released by applying pressure to the other of the members causing an increase in tension in the tension springs to a predetermined value when the latching means is released. When this occurs, the members can move relative to one another under the action of the tension springs causing a sudden jarring or hammering effect.

An object of the present invention is to provide an improved jarring device which is simple to operate and which is robust, reliable in use, and has low wear characteristics.

A further object is to provide a jarring device in which the jarring impacts are directed in both longitudinal directions.

SUMMARY OF THE INVENTION

According to the present invention there is provided in a jarring device for use in drilling which jarring device comprises first and second members longitudinally relatively movable between a locked position and a released position the improvement which comprises:

providing control means including first and second locking devices, said first locking device having a release position and a locking position to prevent relative movement between said members until a predetermined force is applied to one of said movable members in one longitudinal direction, and said second locking device having a release position and a locking position to prevent relative movement between said members until a predetermined force is applied to one of said movable members in the opposite longitudinal direction.

Preferably, said first relatively movable member is a tubular outer member and said second relatively movable member is a ram disposed within said tubular outer member. Said ram and said tubular outer member are provided with respective connecting means to enable them to be connected to an associated drill string component.

In one embodiment of the invention at least one of said locking devices comprises a plurality of radially distributed pivoting bolts, each bolt having a pivoted end and a bearing end, and an abutment is provided on one of said movable members. The locking position of said locking device corresponds to a position in which the bolts are pivoted into a radial configuration wherein the bearing ends thereof contact said abutment, and the release position of said locking device corresponds to a position in which the bolts are pivoted into a radial configuration wherein the bearing ends thereof are clear of said abutment.

In this embodiment there may be provided spring means associated with said locking members, said spring means being compressible by said predetermined force in one longitudinal direction to cause one of said locking devices to move from its locking position to its release position, and said spring means being compressible by said predetermined force in the opposite longitudinal direction to cause the other of said locking devices to move from its locking position to its release position.

In a preferred embodiment of the invention there is provided in a jarring device for use in drilling comprising a tubular outer member and a ram longitudinally movable within said tubular outer member the improvement which comprises:

providing control means including first and second locking devices, said first locking device having a release position and a locking position to prevent relative movement between said members until a predetermined force is applied to one of said movable members in one longitudinal direction, and said second locking device having a release position and a locking position to prevent relative movement between said members until a predetermined force is applied to one of said movable members in the opposite longitudinal direction, at least one of said locking devices comprising a plurality of radially distributed pivoting bolts, each bolt having a pivoted end and a bearing end, an abutment on one of said movable members, the locking position of said locking device corresponding to a position in which the bolts are pivoted into a radial configuration wherein the bearing ends thereof contact said abutment, and the release position of said locking device corresponding to a position in which the bolts are pivoted into a radial configuration wherein the bearing ends thereof are clear of said abutment, spring means associated with said locking members, said spring means being compressible by said predetermined force in one longitudinal direction to cause one of said locking devices to move from its locking position to its release position, and said spring means being compressible by said predetermined force in the opposite longitudinal direction to cause the other of said locking devices to move from its locking position to its release position, each locking means including a sliding sleeve arranged to slide within said outer tubular member, each sliding sleeve having an outer end face, a locking collar having an opposed end face for engagement with said outer end face of said sliding sleeve, and an inner face which engages with the pivoting bolts to hold them into contact with the abutment whilst in the locking position, said spring means urging said sliding sleeve towards said locking collar.

In this embodiment the outer tubular member may be constructed in at least two parts having cooperating screw formations which can be screwed together, and a spacer of predetermined axial dimension is provided which determines the compression of the spring means when said parts are screwed together.

The opposed end faces of the locking collars and the bearing ends of the pivoting bolts may have sloping surfaces which mutually interact to urge the bolts into the locking position under the pressure applied by the spring means.

The abutment may be an annular surface provided on the ram.

Each pivoting bolt may be provided with a curved end face at its pivoted end, the curved end face being received and supported in a bearing socket provided in the associated sliding sleeve. Each pivoting bolt in a sliding sleeve is provided with a groove near to its pivoting axis and a spreader ring is disposed within each groove to urge said bolts into engagement with said sliding sleeve.

The control device provides for a locking of the ram and outer tubular member against relative movement which locking can be released in both axial directions. The provision of spring means common to the two locking means guarantees that the conditions of release are the same in both cases. A variation in the spring prestressing will change the conditions of release similarly in both longitudinal directions.

Furthermore, the control means is of a simple design which has low wear susceptibility and which takes up only a small axial length despite the double function capability. The control device is also extremely reliable, since the sliding sleeves act directly on the spring means and the pivoting bolts are positively returned via sloping sliding surfaces into their engaged position on the associated abutment, as soon as the ram and outer tubular member return to their initial position.

Since the control means has spring means common to the two locking means, the selected displacement travel of the ram and outer tubular member between the locked position and their released position can be relatively long whilst maintaining a comparatively small axial length of the control means. Changes in the length of travel and angle of the components of the control means due to unavoidable wear have little practical effect on the predetermined release conditions.

DESCRIPTION OF THE PREFERRED EMBODIMENT

Figure 1:
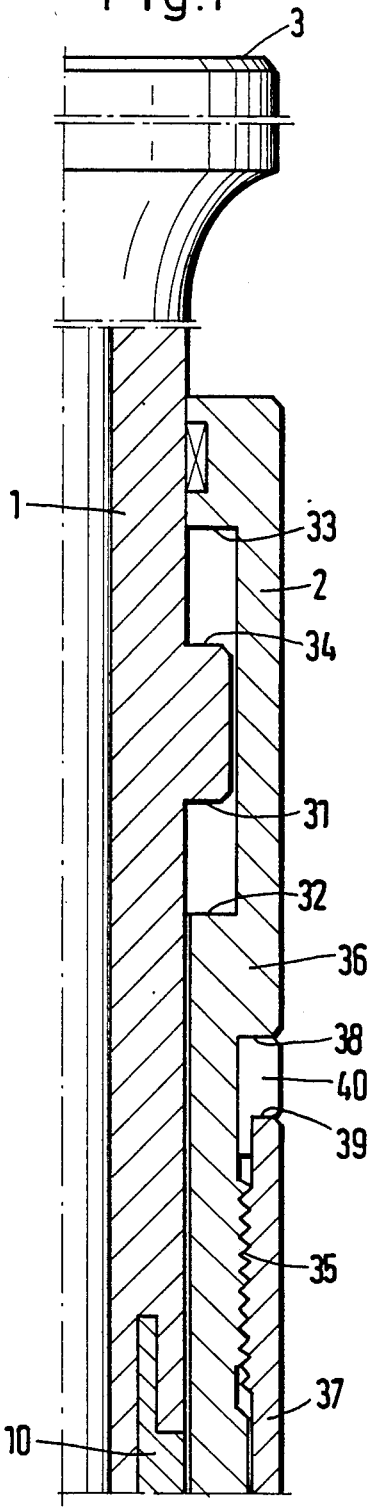
FIG. 1 is a longitudinal half section of an upper portion of a jarring device according to the invention.
Figure 2:
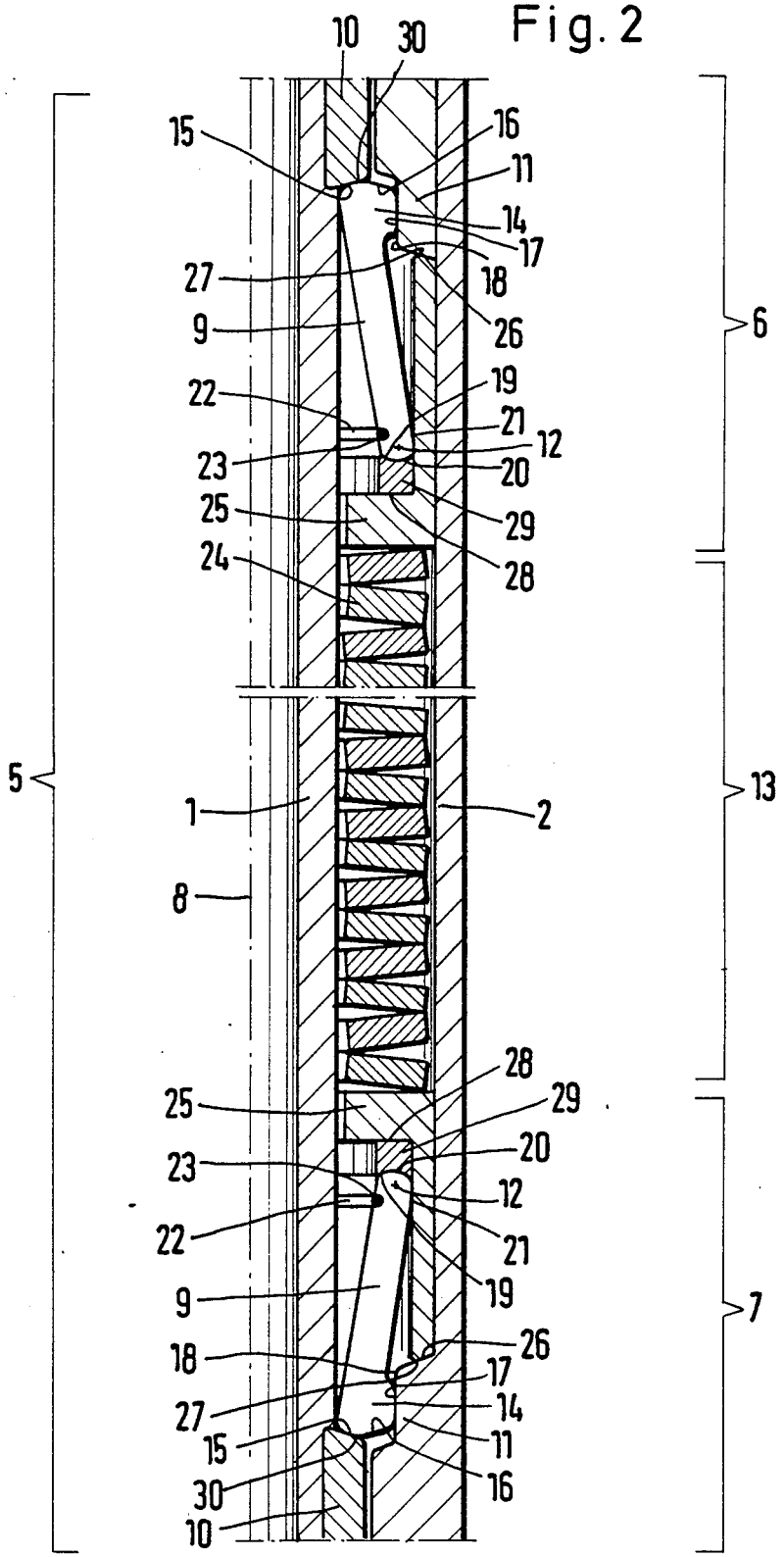
FIG. 2 is a longitudinal half section of a centre portion of a jarring device according to the invention.
Figure 3:
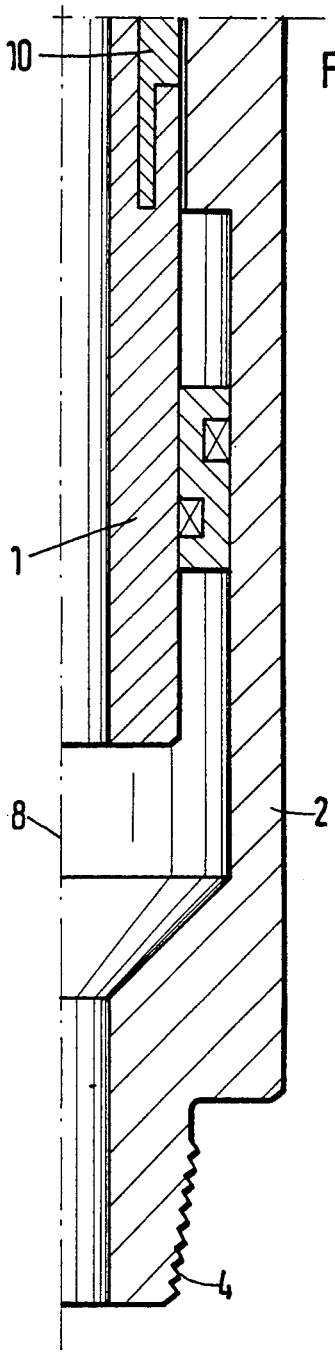
FIG. 3 is a longitudinal half section of a lower portion of a jarring device according to the invention.

The jarring device illustrated in the drawing comprises a ram 1 and an outer tubular member 2 which are displaceable telescopically relative to one another between a retracted position and an extended position. The ram 1 and the outer tubular member 2 carry, at their outer ends respectively, threaded extensions 3 and 4, by means of which they can be attached to adjacent elements, for example in a drill string.

In the neutral or engaged position, the ram 1, and the outer tubular member 2 are locked by means of a control device 5 which consists of an upper part 6 and a lower part 7. The lower part 7 serves to lock the ram and outer tubular member against being pulled apart out of the neutral or engaged position, and the upper part 6 locks them against being pressed together.

Each of the parts 6 and 7, which are identical to one another, comprises a plurality of pivoting bolts 9 arranged coaxially relative to an axis 8 of the ram and outer tubular member, an abutment 10 arranged on the ram 1 and a locking collar 11 connected to the outer tubular member 2.

Each pivoting bolt 9 is supported by a spring arrangement 13 so as to be pivotable about one particular pivot axis 12 in each case and is provided at the free end with a thickened porition 14 which has a first sloping sliding surface 15 and a further sloping sliding surface 16. The pivoting bolts 9 are designed as longitudinal segments of a cylindrical sleeve and narrow down from a region of maximum width, located near the pivot axis 12, in the peripheral direction to a region of minimum width at the free end 14.

In the engaged position shown, the pivoting bolts 9 are therefore close to one another in the peripheral direction and thus present an approximately conical surface. Also, in the engaged position shown, all the outer faces 17 of the free ends 14 are located on a cylindrical annular surface, the radius of curvature of which corresponds to that of the inner surface 18 of the locking collar 11.

Each pivoting bolt 9 has at its other end a curved end face 19, by means of which it is supported in a bearing socket 20 associated with a sliding sleeve 25, and is also bevelled on the outer face 21 located in the region of the pivot axis 12. On their inside, the pivoting bolts 9 are provided with a groove 22, into which a common spreader ring 23 engages.

The spring arrangement 13 consists of a spring means common to the two parts 5 and 6, in the form of a spring assembly 24 which can be equipped, for example, with cup springs, and of two sliding sleeves 25 one of which is associated with each part 6 and 7. The sliding sleeves in the neutral or engaged position have their outer end faces 26 urged against the bevelled end faces 27 of the locking collars 11. The pivoting bolts 9 are each supported on the respective inner end faces 28 of the sliding sleeves 25 by means of a support ring 29, in which the bearing sockets 20 are formed.

In the engaged position illustrated, the pivoting bolts 9 of the control device 5 lock a longitudinal displacement of the abutment 10 which exceeds a certain play, since the sloping end faces 30 of the abutments 10 connected firmly to the ram 1 are up against the surfaces 15 of the pivoting bolts 9 of one of the parts 6 or 7.

When a pull is exerted on the device from above ground by means of the drill string, the abutment 10 of the part 7 comes up against the surfaces 15 of the associated pivoting bolts 9 via its face 30. As the pull is increased, the pivoting bolts 9 of the part 7 move upwards within the outer tubular member 2, and by means of their annular surfaces 17 they slide along on the inner surface 18 of the locking collar 11. At the same time the sliding sleeve 25 moves to compress the spring assembly 24 whilst forming a gap between the faces 26 and 27. As the pull is increased even further, the pivoting bolts 9 finally come out of the inner region of the locking collar 11 of the part 7 and pivot outwardly about the pivot axes 12, the faces 15 and 30 sliding on one another, until the pivoting bolts 9 are aligned parallel to the axis 8. The outer faces 17 of the free ends 14 then extend into the gap produced between the faces 26 and 27. In this position of the pivoting bolts 9, the abutment 10 can now slide through freely under the pivoting bolts 9 and allow the ram 1 to execute a longitudinal movement relative to the outer tubular member 2, until a stop face 33 on the outer tubular member strikes a stop face 34 on the ram and abruptly ends the longitudinal displacement.

When the ram and outer tubular member are to be returned to their neutral or engaged position again after impact the ram 1 and outer tubular member 2 are brought together, the abutment 10 of the part 7 first sliding under the associated pivoting bolts 9 and back into the position shown. The pivoting bolts 9, which are stressed by the spring assembly 24 via the sliding sleeve 25, at the same time slide along by means of their sloping surfaces 16 on the sloping surface 27 of the locking collar 11 and pivot inwardly. They are subsequently pushed further in under the locking collar 11, until the outer end face 26 of the sliding sleeve 25 comes up against the end face 27 of the locking collar 11.

To obtain a pressure force on the drill string to exert an impact directed downwardly, downward pressure is applied to the ram 1 and a similar operating cycle for the part 6 occurs to that described above in relation to part 7. After the control device 5 has been released and the ram 1 and outer tubular member 2 have been pushed together, the impact is exerted because the stop face 31 of the ram 1 strikes against the stop face 32 of the outer tubular member 2.

The predetermined releasing force can be adjusted by varying the distance between the end faces 27 of the locking collars 11 which compress and prestress the spring assembly 24 via the sliding sleeves 25. The adjustment can be made by constructing the outer tubular member in two parts 36 and 37 which are connected by a cylindrical thread 35 and which are spaced by means of their shoulders 38 and 39 abutting against a spacer body 40. The force can be predetermined by selecting a spacer of an appropriate width.

What is claimed is:

1. In a jarring device for use in drilling which jar device comprises first and second members longitudinally relatively movable between a locked position and a released position the improvement which comprises:

providing control means including first and second locking devices arranged between and slidable relative to both said first and second members;

said first locking device having a release position and a locking position to prevent relative movement between said members until a predetermined force is applied to one of said movable members in one longitudinal direction;

said second locking device having a release position and a locking position to prevent relative movement between said members until a predetermined force is applied to one of said movable members in the opposite longitudinal direction;

spring means longitudinally interposed between said first and second locking devices for normally maintaining said locking devices in said locking position, said predetermined force being sufficient to longitudinally displace one of said locking devices against the urging of said spring means out of said locking position and into said release position.

2. A device as defined in claim 1 wherein said first relatively movable member is a tubular outer member and said second relatively movable member is a ram disposed within said tubular outer member.

3. A device as defined in claim 2 wherein said ram and said tubular outer member are provided with respective connecting means to enable them to be connected to an associated drill string component.

4. In a jarring device for use in drilling which jar device comprises first and second members longitudinally relatively movable between a locked position and a released position the improvement which comprises:

providing control means including first and second locking devices, said first locking device having a release position and a locking position to prevent relative movement between said members until predetermined force is applied to one of said movable members in one longitudinal direction, and said second locking device having a release position and a locking position to prevent relative movement between said members until a predetermined force is applied to one of said movable members in the opposite longitudinal direction, at least one of said locking devices comprising a plurality of radially distributed pivoting bolts, each bolt having a pivoted end and a bearing end, an abutment on one of said movable members, the locking position in which the bolts are pivoted into a radial configuration wherein the bearing ends thereof contact said abutment, and the release position of said locking device corresponding to a position in which the bolts are pivoted into a radial configuration wherein the bearing ends thereof are clear of said abutment, spring means associated with said locking members, said spring means being compressible by said predetermined force in one longitudinal direction to cause one of said locking devices to move from its locking position to its release position, and said spring means being compressible by said predetermined force in the opposite longitudinal direction to cause the other of said locking devices to move from its locking position to its release position.

5. A device as defined in claim 4 wherein said spring means is a spring common to both locking means.

6. In a jarring device for use in drilling comprising a tubular outer member and a ram longitudinally movable within said tubular outer member the improvement which comprises:

providing control means including first and second locking devices, said first locking device having a release position and a locking position to prevent relative movement between said members until a predetermined force is applied to one of said movable members in one longitudinal direction, and said second locking device having a release position and a locking position to prevent relative movement between said members until a predetermined force is applied to one of said movable members in the opposite longitudinal direction, at least one of said locking devices comprising a plurality of radially distributed pivoting bolts, each bolt having a pivoted end and a bearing end, an abutment on one of said movable members, the locking position of said locking device corresponding to a position in which the bolts are pivoted into a radial configuration wherein the bearing ends thereof contact said abutment, and the release position of said locking device corresponding to a position in which the bolts are pivoted into a radial configuration wherein the bearing ends thereof are clear of said abutment, spring means normally urging said locking members towards said locking position, said same spring means being compressible by said predetermined force in one longitudinal direction to cause one of said locking devices to move from its locking position to its release position, and said spring means being compressible by said predetermined force in the opposite longitudinal direction to cause the other of said locking devices to move from its locking position to its release position, each locking means including a sliding sleeve arranged to slide within said outer tubular member, each sliding sleeve having an outer end face, locking collar on the other of said movable members having an end face opposed for engagement with said outer end face of said sliding sleeve, and an inner face which engages with the pivoting bolts to hold them into contact with the abutment whilst in the locking position, said spring means urging said sliding sleeve towards said locking collar.

7. A device as defined in claim 6 wherein the outer tubular member is constructed in at least two parts having cooperating screw formations which can be screwed together, and a spacer of predetermined axial dimension is provided which determines the compression of the spring means when said parts are screwed together.

8. A device as defined in claim 6 wherein the opposed end faces of the locking collars and the bearing ends of the pivoting bolts may have sloping surfaces which mutally interact to urge the bolts into the locking position under the pressure applied by the spring means.

9. A device as defined in claim 6 in which the abutment is an annular surface provided on the ram.

10. A device as defined in claim 6 in which each pivoting bolts is provided with a curved end face at its pivoted end, the curved end face being received and supported in a bearing socket provided in the associated sliding sleeve.

11. A device as defined in claim 6 in which each pivoting bolt in a sliding sleeve is provided with a groove near to its pivoting axis and a spreader ring is disposed within each groove to urge said bolts into engagement with said sliding sleeve.

* * * * *